US010913272B2

(12) United States Patent
Takemoto et al.

(10) Patent No.: US 10,913,272 B2
(45) Date of Patent: Feb. 9, 2021

(54) LIQUID EJECTING HEAD AND LIQUID EJECTING APPARATUS

(71) Applicant: Seiko Epson Corporation, Tokyo (JP)

(72) Inventors: Satoshi Takemoto, Shiojiri (JP); Eiju Hirai, Azumino (JP); Masao Nakayama, Shiojiri (JP); Naoto Yokoyama, Matsumoto (JP); Osamu Tonomura, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/449,584

(22) Filed: Jun. 24, 2019

(65) Prior Publication Data

US 2019/0389218 A1 Dec. 26, 2019

(30) Foreign Application Priority Data

Jun. 25, 2018 (JP) ..... 2018-119540
Dec. 11, 2018 (JP) ..... 2018-231369

(51) Int. Cl.
*B41J 2/14* (2006.01)

(52) U.S. Cl.
CPC ..... *B41J 2/14233* (2013.01)

(58) Field of Classification Search
CPC ..... B41J 2/14233; B41J 2/161; B41J 2/1606; B41J 2/1646; B41J 2/1642; B41J 2/1629; B41J 2/1631
See application file for complete search history.

(56) References Cited

U.S. PATENT DOCUMENTS

2003/0025767 A1* 2/2003 Sakamoto ..... B41J 2/1646 347/68
2017/0113462 A1 4/2017 Takahashi et al.

FOREIGN PATENT DOCUMENTS

JP 2017-080946 A 5/2017

OTHER PUBLICATIONS

IP.com search (Year: 2020).*

* cited by examiner

*Primary Examiner* — Lisa Solomon
(74) *Attorney, Agent, or Firm* — Harness, Dickey & Pierce, P.L.C.

(57) ABSTRACT

A liquid ejecting head includes a vibration plate constituting a part of a wall surface of a pressure chamber accommodating a liquid; a piezoelectric element vibrating the vibration plate; and a reinforcing film disposed on a surface of the vibration plate on a pressure chamber side, in which a vibration region, which is a region of the vibration plate and is vibrated by the piezoelectric element, has an elongated shape in a plan view viewed in a thickness direction of the vibration plate, and the vibration region includes a first region in which the reinforcing film is not disposed and a second region which is located at a position closer to a center of the vibration region in a longitudinal direction than the first region, and in which the reinforcing film is disposed.

7 Claims, 14 Drawing Sheets

LIQUID EJECTING HEAD AND LIQUID EJECTING APPARATUS

The present application is based on, and claims priority from, JP Application Serial Number 2018-119540, filed Jun. 25, 2018, and JP Application Serial Number 2018-231369, filed Dec. 11, 2018, the disclosures of which are hereby incorporated by reference herein in their entireties.

BACKGROUND

1. Technical Field

The present disclosure relates to a liquid ejecting head and a liquid ejecting apparatus.

2. Related Art

For example, as disclosed in JP-A-2017-80946, a liquid ejecting head, which ejects a liquid in a pressure chamber from a nozzle by vibrating a vibration plate constituting a part of a wall surface of the pressure chamber by a piezoelectric element, is known.

In the liquid ejecting head, in general, from a viewpoint of efficiently ejecting the liquid from the nozzle, a pressure in the pressure chamber by the piezoelectric element increases toward a center of the pressure chamber in a longitudinal direction. Therefore, a reaction force that the vibration plate receives from the liquid in the pressure chamber increases toward the center of the vibration plate in the longitudinal direction. Since the liquid ejecting head described in JP-A-2017-80946 has no consideration on an influence of the reaction force by the vibration plate, there is a possibility that the center portion of the vibration plate in the longitudinal direction is excessively deformed and damaged by the reaction force described above. In recent years, along with narrowing of a nozzle pitch, a width of the vibration plate becomes narrower, and accordingly, thinning of the vibration plate is required, so that the possibility described above increases.

SUMMARY

According to an aspect of the present disclosure, there is provided a liquid ejecting head including: a vibration plate constituting a part of a wall surface of a pressure chamber accommodating a liquid; a piezoelectric element vibrating the vibration plate; and a reinforcing film disposed on a surface of the vibration plate on a pressure chamber side, in which a vibration region, which is a region of the vibration plate and is vibrated by the piezoelectric element, has an elongated shape in a plan view viewed in a thickness direction of the vibration plate, and in which the reinforcing film includes a first portion having a first film thickness and a second portion which is located at a position closer to a center of the vibration region in a longitudinal direction than the first portion, and has a second film thickness thicker than the first film thickness.

According to another aspect of the present disclosure, there is provided a liquid ejecting head including: a vibration plate constituting a part of a wall surface of a pressure chamber accommodating a liquid; a piezoelectric element vibrating the vibration plate; and a reinforcing film disposed on a surface of the vibration plate on a pressure chamber side, in which a vibration region, which is a region of the vibration plate and is vibrated by the piezoelectric element, has an elongated shape in a plan view viewed in a thickness direction of the vibration plate, and in which the vibration region includes a first region in which the reinforcing film is not disposed and a second region which is located at a position closer to a center of the vibration region in a longitudinal direction than the first region, and in which the reinforcing film is disposed.

DESCRIPTION OF EXEMPLARY EMBODIMENTS

1. First Embodiment

1-1 Entire Configuration of Liquid Ejecting Apparatus

Figure 1:
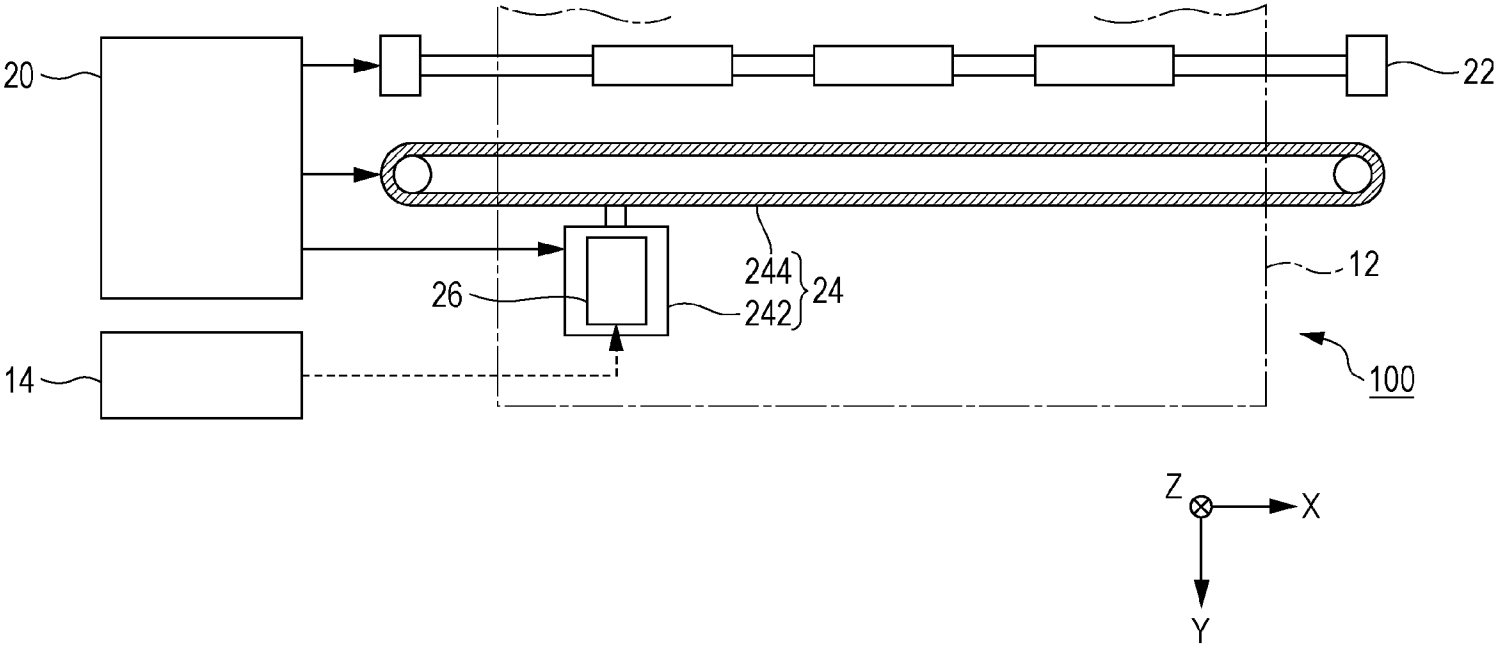
FIG. 1 is a configuration view schematically illustrating a liquid ejecting apparatus according to a first embodiment.

FIG. 1 is a configuration view schematically illustrating a liquid ejecting apparatus 100 according to a first embodiment. The liquid ejecting apparatus 100 of the first embodiment is an ink jet type printing apparatus that ejects ink, which is an example of a liquid, onto a medium 12. The medium 12 is typically printing paper, but a printing target of any material such as a resin film or cloth is used as the medium 12. As illustrated in FIG. 1, the liquid ejecting apparatus 100 is provided with a liquid container 14 that stores the ink. For example, a cartridge removably attached to the liquid ejecting apparatus 100, a bag-like ink pack formed of a flexible film, or an ink tank capable of being refilled with the ink is used as the liquid container 14.

As illustrated in FIG. 1, the liquid ejecting apparatus 100 includes a control unit 20, a transport mechanism 22, a moving mechanism 24, and a liquid ejecting head 26. The control unit 20 includes a processing circuit such as a Central Processing Unit (CPU) or a Field Programmable Gate Array (FPGA) and a memory circuit such as a semiconductor memory, and totally controls respective elements of the liquid ejecting apparatus 100. The transport mechanism 22 transports the medium 12 in a Y direction under the control of the control unit 20.

The moving mechanism 24 reciprocates the liquid ejecting head 26 in an X direction under the control of the control unit 20. The X direction is a direction intersecting the Y direction in which the medium 12 is transported, and is typically orthogonal to the Y direction. The moving mechanism 24 of the first embodiment includes a carriage 242 which is a substantially box type transport body accommodating the liquid ejecting head 26, and a transport belt 244 to which the carriage 242 is fixed. A configuration in which a plurality of liquid ejecting heads 26 are mounted on the carriage 242, or a configuration in which the liquid container 14 is mounted on the carriage 242 together with the liquid ejecting head 26 may be adopted.

The liquid ejecting head 26 ejects the ink supplied from the liquid container 14 onto the medium 12 from a plurality of nozzles under the control of the control unit 20. A desired image is formed on a surface of the medium 12 by ejecting the ink to the medium 12 by each liquid ejecting head 26 concurrently with the transportation of the medium 12 by the transport mechanism 22 and the repetitive reciprocation of the carriage 242.

1-2 Entire Configuration of Liquid Ejecting Head

Figure 2:
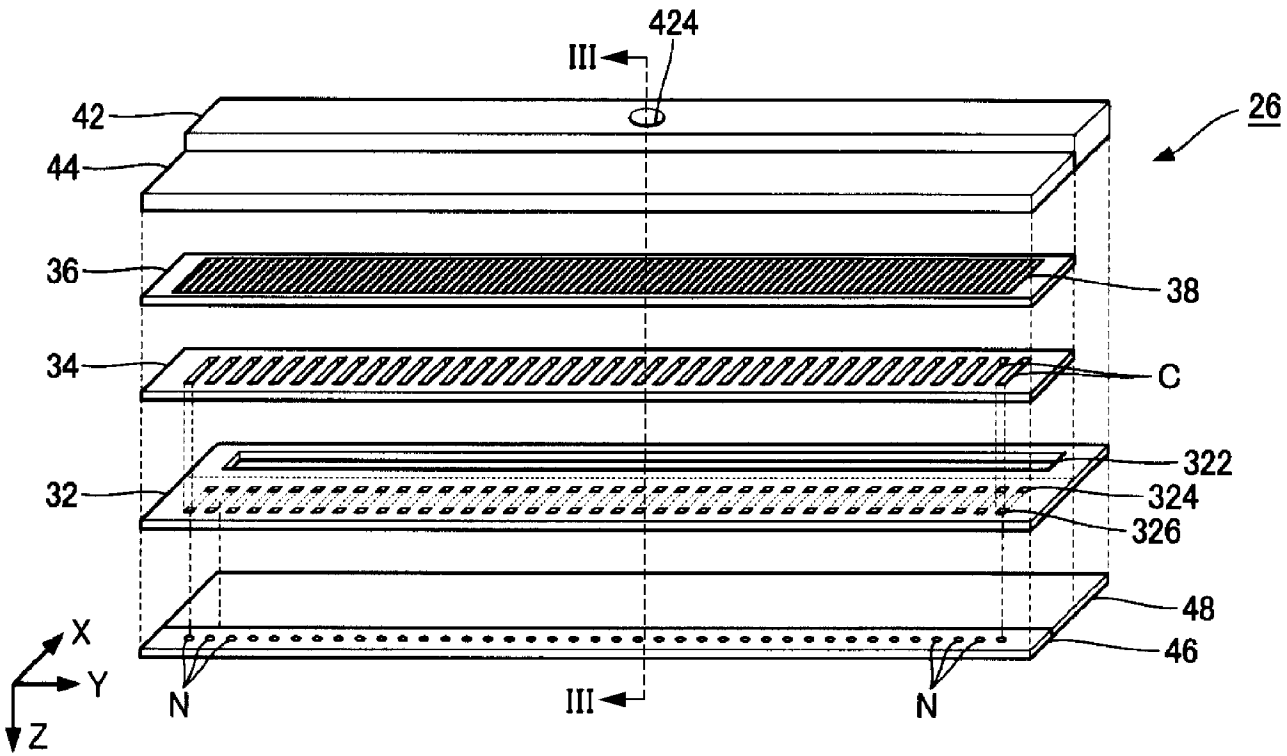
FIG. 2 is an exploded perspective view of a liquid ejecting head according to the first embodiment.
Figure 3:
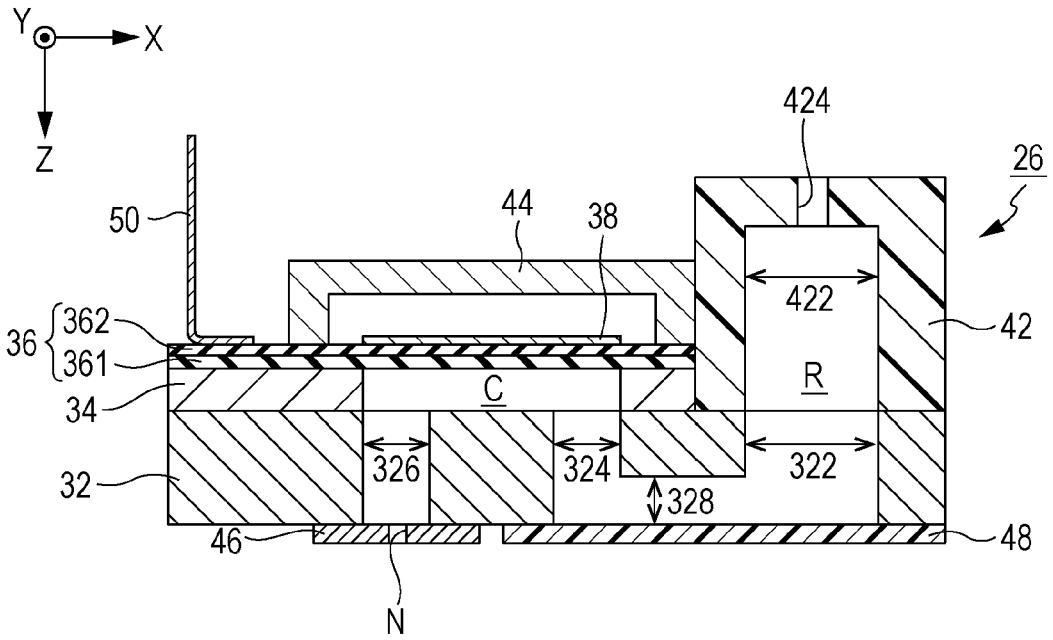
FIG. 3 is a sectional view which is taken along line III-III of FIG. 2.

FIG. 2 is an exploded perspective view of the liquid ejecting head 26 according to the first embodiment. FIG. 3 is a sectional view which is taken along line III-III of FIG. 2, that is, a sectional view parallel to an X-Z plane. As illustrated in FIG. 2, hereinafter, a direction perpendicular to an X-Y plane is referred to as a Z direction. An ejecting direction of the ink by each liquid ejecting head 26, typically a vertical direction corresponds to the Z direction.

As illustrated in FIGS. 2 and 3, the liquid ejecting head 26 includes a substantially rectangular flow path substrate 32 elongated in the Y direction. A pressure chamber substrate 34, a vibration plate 36, a plurality of piezoelectric elements 38, a casing portion 42, and a sealing body 44 are disposed on a surface of the flow path substrate 32 on a negative side in the Z direction. On the other hand, a nozzle plate 46 and a vibration absorber 48 are disposed on a surface of the flow path substrate 32 on a positive side in the Z direction. Respective elements of the liquid ejecting head 26 are substantially plate-like members elongated in the Y direction substantially similar to the flow path substrate 32, and are joined to each other using, for example, an adhesive.

As illustrated in FIG. 2, the nozzle plate 46 is a plate-like member on which a plurality of nozzles N arranged in the Y direction are formed. Each nozzle N is a through-hole through which ink passes. The flow path substrate 32, the pressure chamber substrate 34, and the nozzle plate 46 are formed, for example, by processing a single crystal substrate of silicon (Si) by a semiconductor manufacturing technique such as etching. However, a material and a manufacturing method of respective elements of the liquid ejecting head 26 may be changed. The Y direction can also be said to be a direction in which the plurality of nozzles N are arranged.

The flow path substrate 32 is a plate-like member for forming a flow path of the ink. As illustrated in FIGS. 2 and 3, the flow path substrate 32 is formed with an opening portion 322, a supply flow path 324, and a communication flow path 326. The opening portion 322 is a through-hole having an elongated shape in the Y direction in a plan view in the Z direction so as to be continuous over the plurality of nozzles N. On the other hand, the supply flow path 324 and the communication flow path 326 are through-holes individually formed for each nozzle N. In addition, as illustrated in FIG. 3, a relay flow path 328 extending over a plurality of supply flow paths 324 is formed on a surface of the flow path substrate 32 on the positive side in the Z direction. The relay flow path 328 is a flow path communicating with the opening portion 322 and the plurality of supply flow paths 324. Hereinafter, the plan view in the Z direction is simply referred to as "plan view".

The casing portion 42 is a structure manufactured, for example, by injection molding of a resin material, and is fixed to the surface of the flow path substrate 32 on the negative side in the Z direction. As illustrated in FIG. 3, the casing portion 42 is formed with an accommodation portion 422 and an introduction port 424. The accommodation portion 422 is a recess portion having an outer shape corresponding to the opening portion 322 of the flow path substrate 32, and the introduction port 424 is a through-hole communicating with the accommodation portion 422. As illustrated in FIG. 3, a space, which allows the opening portion 322 of the flow path substrate 32 and the accommodation portion 422 of the casing portion 42 to communicate with each other, functions as a liquid storage chamber R that is a reservoir. The ink, which is supplied from the liquid container 14 and passes through the introduction port 424, is stored in the liquid storage chamber R.

The vibration absorber 48 is an element for absorbing pressure fluctuations in the liquid storage chamber R, and is configured to include, for example, a compliance substrate which is a flexible sheet member capable of being elastically deformed. Specifically, the vibration absorber 48 is disposed on the surface of the flow path substrate 32 on the positive side in the Z direction, so that the opening portion 322 of the flow path substrate 32, the relay flow path 328, and the plurality of supply flow paths 324 are closed to constitute a bottom surface of the liquid storage chamber R.

As illustrated in FIGS. 2 and 3, the pressure chamber substrate 34 is a plate-like member on which a plurality of pressure chambers C corresponding to different nozzles N are formed. The plurality of pressure chambers C are arranged in the Y direction. Each pressure chamber C is a cavity formed by using a hole 341 opening on both surfaces of the pressure chamber substrate 34, and has an elongated shape in the X direction in a plan view. An end portion of the pressure chamber C on the positive side in the X direction overlaps with one supply flow path 324 of the flow path substrate 32 in a plan view, and an end portion of the pressure chamber C on the negative side in the X direction overlaps with one communication flow path 326 of the flow path substrate 32 in a plan view.

The vibration plate 36 is disposed on the surface of the pressure chamber substrate 34 on a side opposite to the flow path substrate 32. The vibration plate 36 is an elastically deformable plate-like member. As illustrated in FIG. 3, the vibration plate 36 of the first embodiment is formed by laminating a first layer 361 and a second layer 362. The second layer 362 is positioned on a side opposite to the pressure chamber substrate 34 as viewed from the first layer 361. The first layer 361 is an elastic film formed of an elastic material such as silicon oxide ($SiO_2$), and the second layer 362 is an insulating film formed of an insulating material such as zirconium oxide ($ZrO_2$). The first layer 361 and the second layer 362 are respectively formed by a known film formation technique such as thermal oxidation or sputtering. A part or all of the pressure chamber substrate 34 and the vibration plate 36 may be integrally formed by selectively removing a part of a region, which corresponds to the pressure chamber C, of the plate-like member having a predetermined plate thickness in a plate thickness direction.

As illustrated in FIG. 3, the flow path substrate 32 and the vibration plate 36 face each other with an interval inside each pressure chamber C. The pressure chamber C is a space located between the flow path substrate 32 and the vibration plate 36, and is provided for applying a pressure to the ink with which the pressure chamber C is filled. The ink stored in the liquid storage chamber R branches from the relay flow path 328 to respective supply flow paths 324 and is supplied to the plurality of pressure chambers C side by side to fill thereto. As described above, the vibration plate 36 constitutes a part of a wall surface of the pressure chamber C, specifically, an upper surface that is one surface of the pressure chamber C.

As illustrated in FIGS. 2 and 3, the plurality of piezoelectric elements 38 corresponding to different nozzles N or the pressure chambers C are disposed on a surface of the vibration plate 36 on a side opposite to the pressure chamber C, that is, a surface of the second layer 362. Each piezoelectric element 38 is an actuator that deforms when a drive signal is supplied, and has an elongated shape in the X direction in a plan view. The plurality of piezoelectric elements 38 are arranged in the Y direction so as to correspond to the plurality of pressure chambers C. When the vibration plate 36 vibrates in conjunction with the deformation of the piezoelectric element 38, an internal pressure in the pressure chamber C varies, and thereby the ink is ejected from the nozzle N.

The sealing body 44 illustrated in FIGS. 2 and 3 is a structure for protecting the plurality of piezoelectric elements 38 and for reinforcing a mechanical strength of the pressure chamber substrate 34 and the vibration plate 36, and is fixed to the surface of the vibration plate 36 using, for example, an adhesive. The plurality of piezoelectric elements 38 are accommodated inside the recess portion formed on a surface of the sealing body 44 facing the vibration plate 36.

As illustrated in FIG. 3, for example, a wiring substrate 50 is bonded to the surface of the vibration plate 36 or the surface of the pressure chamber substrate 34. The wiring substrate 50 is a mounted component on which a plurality of wirings for electrically connecting the control unit 20 and the liquid ejecting head 26 are formed. For example, a flexible wiring substrate such as a Flexible Printed Circuit (FPC) or a Flexible Flat Cable (FFC) is suitably adopted as the wiring substrate 50. A drive signal for driving the piezoelectric element 38 is supplied from the wiring substrate 50 to each piezoelectric element 38.

1-3. Details of Pressure Chamber and Vibration Plate

Figure 4:
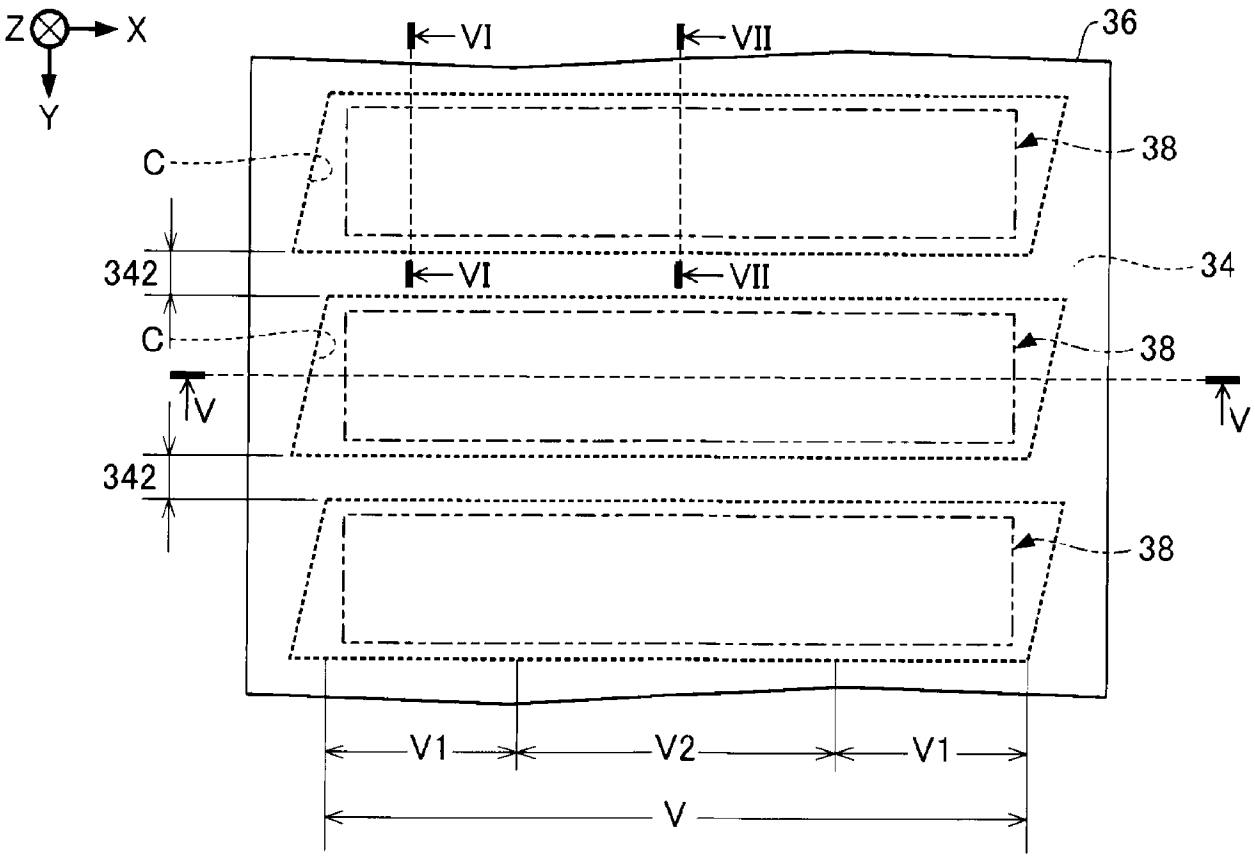
FIG. 4 is a plan view illustrating a vibration plate of the liquid ejecting head according to the first embodiment.
Figure 5:
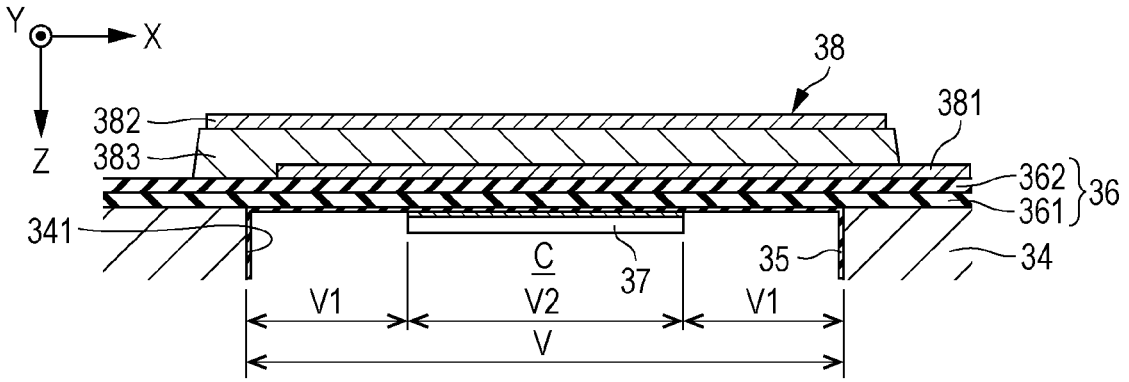
FIG. 5 is a sectional view which is taken along line V-V of FIG. 4.
Figure 6:
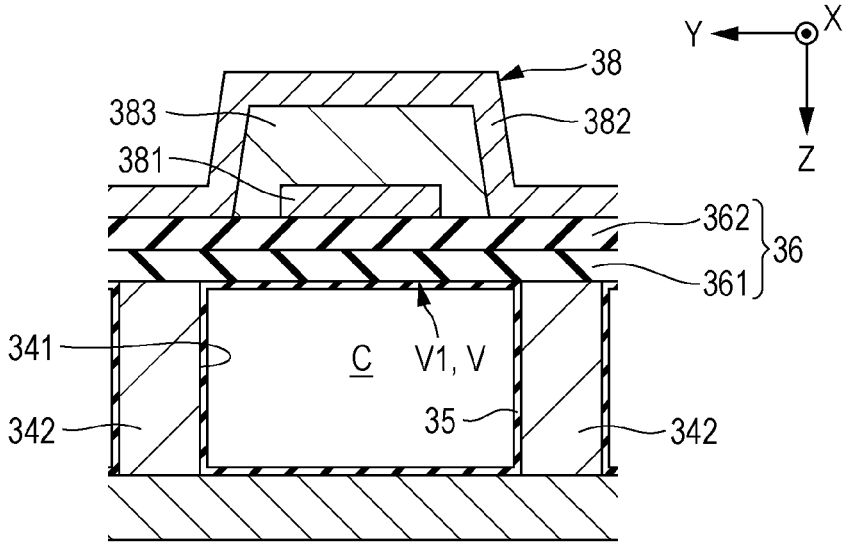
FIG. 6 is a sectional view which is taken along line VI-VI of FIG. 4.
Figure 7:
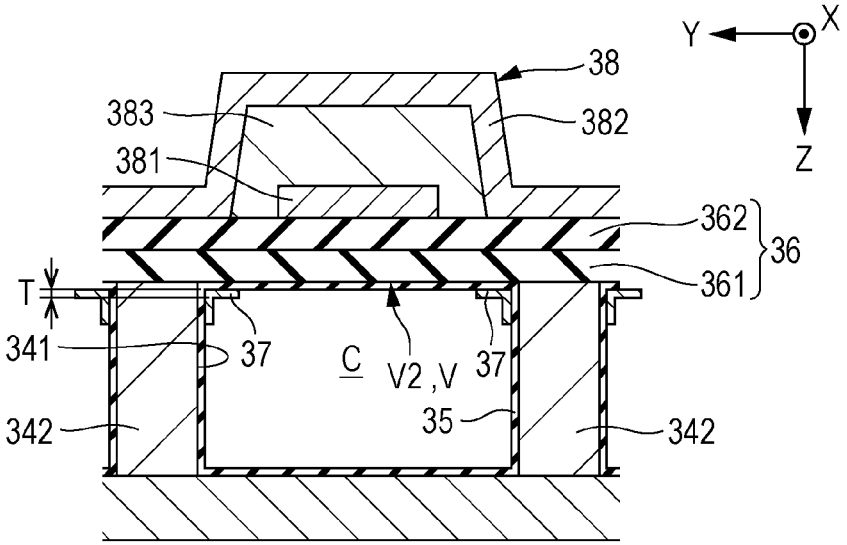
FIG. 7 is a sectional view which is taken along line VII-VII of FIG. 4.

FIG. 4 is a plan view illustrating the vibration plate 36 of the liquid ejecting head 26 according to the first embodiment. FIG. 5 is a sectional view which is taken along line V-V of FIG. 4. FIG. 6 is a sectional view which is taken along line VI-VI of FIG. 4. FIG. 7 is a sectional view which is taken along line VII-VII of FIG. 4. As illustrated in FIG. 4, the vibration plate 36 includes a plurality of vibration regions V having shapes respectively corresponding to the plurality of pressure chambers C in a plan view. The vibration region V is a vibration region which is a region of the vibration plate 36 and is vibrated by the piezoelectric element 38. In other words, the vibration region V is a region that can vibrate without being in contact with the pressure chamber substrate 34 in a region of the vibration plate 36.

Here, as described above, each pressure chamber C has an elongated shape in the X direction which is a first direction in a plan view. Therefore, each vibration region V has an elongated shape extending in the X direction in a plan view. In addition, each pressure chamber C is formed, for example, by anisotropically etching a silicon single crystal substrate of which a plate surface is a (110) plane. Therefore, a shape of each pressure chamber C or each vibration region V in a plan view is a shape along a (111) plane of the single crystal substrate. Moreover, the shape of each pressure chamber C or each vibration region V in a plan view is not limited to the illustrated shape.

A corrosion resistant film 35 for protecting the wall surface from the ink is disposed on the wall surface of the pressure chamber C. The corrosion resistant film 35 has higher resistance to the ink in the pressure chamber C than that of the vibration plate 36. A constituting material of the corrosion resistant film 35 is not particularly limited as long as the material has resistance with respect to the ink in the pressure chamber C, but for example, includes silicon oxide such as silicon oxide ($SiO_2$), metal oxides such as tantalum oxide ($TaO_X$) and zirconium oxide ($ZrO_2$), metals such as nickel (Ni) and chromium (Cr), or the like. The corrosion resistant film 35 may be constituted of a single layer of a single material or may be constituted of a laminated body of a plurality of layers formed of different materials. Although a thickness of the corrosion resistant film 35 is not particularly limited, it is preferable that the thickness is within a range of 0.1 μm or more and 1000 μm or less. Moreover, the corrosion resistant film 35 may be provided if necessary, and may be omitted. In addition, it can be said that a part of the corrosion resistant film 35 has a function of reinforcing the vibration region V together with a reinforcing film 37 which is described later.

As illustrated in FIG. 5, the reinforcing film 37 for reinforcing the vibration region V is disposed on the surface of the vibration region V of the vibration plate 36 on a pressure chamber C side. In the embodiment, the reinforcing film 37 is disposed on the corrosion resistant film 35 which is described above. In addition, the reinforcing film 37 is unevenly distributed closer to a center of the vibration region V in the longitudinal direction. That is, the vibration region V includes first regions V1 in which the reinforcing film 37 is not disposed, and a second region V2 which is located at a position closer to the center of the vibration region V in the longitudinal direction than the first regions V1, and in which the reinforcing film 37 is disposed. The vibration region V illustrated in FIG. 5 includes two first regions V1 and the second region V2 located between the two first regions V1.

Here, as described above, the liquid ejecting head 26 includes the pressure chamber substrate 34 which is a substrate in which the vibration plate 36 is disposed. As illustrated in FIGS. 5, 6, and 7, the pressure chamber substrate 34 is provided with the hole 341 constituting the pressure chamber C. As illustrated in FIGS. 6 and 7, a wall-like partition wall portion 342 extending in the X direction is provided between adjacent two pressure chambers C of the pressure chamber substrate 34. As illustrated in FIG. 7, the reinforcing film 37 is disposed on a corner on which the surface of the vibration plate 36 on the pressure chamber C side and a wall surface of the hole 341 are coupled to each other. Most stress is easily generated on the corner in the vibration plate 36. Therefore, the vibration plate 36 can be effectively reinforced by disposing the reinforcing film 37 on the corner. In addition, it is preferable that the reinforcing film 37 is disposed in a region between the piezoelectric element 38 and an outer edge of the pressure chamber C in a plan view. In this region, since the vibration plate 36 is not reinforced by the piezoelectric element 38, it can be said that the vibration plate 36 is easily damaged. Therefore, reinforcing the region by the reinforcing film 37 is effective for preventing the vibration plate 36 from being damaged.

Moreover, the reinforcing film 37 may be disposed on a surface of the wall surface of the pressure chamber C other than the region described above. For example, in FIG. 7, the reinforcing films 37 are unevenly disposed on both end sides of the vibration region V in the Y direction, but the reinforcing film 37 may be disposed at the center of the vibration region V in the Y direction. However, in a case where the reinforcing films 37 are unevenly disposed on the both end sides of the vibration region V in the Y direction, and the reinforcing film 37 is not formed at the center in the Y direction, there is an advantage that an effect of reducing the damage of the vibration region V increases and necessary deformation of the vibration region V can be easily obtained, thereby being preferable as compared with a case where the reinforcing film 37 is disposed at the center of the vibration region V in the Y direction.

A constituting material of the reinforcing film 37 is not particularly limited, and various organic materials or various inorganic materials may be included. The organic material includes, for example, a resin material such as a resist material. The inorganic material includes a metal, a metal oxide, or the like. The reinforcing film 37 may be constituted of a single layer of a single material or may be constituted of a laminate of a plurality of layers of different materials. The constituting material of the reinforcing film 37 may be the same as or different from the constituting material of the corrosion resistant film 35 described above, but from the viewpoint of enhancing the reinforcing effect of the reinforcing film 37, it is preferable that a material having a Young's modulus higher than that of the corrosion resistant film 35 is provided. In addition, in a case of the embodiment, since the reinforcing film 37 is exposed to the ink, it is preferable that the constituting material of the reinforcing film 37 has resistance to the ink.

Here, from the viewpoint that the rigidity of the reinforcing film 37 can be easily increased, the Young's modulus of the constituting material of the reinforcing film 37 is preferably 10 GPa or more, and more preferably 50 GPa or more. From this viewpoint, it is preferable that the constituting material of the reinforcing film 37 is a metal or a metal oxide.

The metal generally has a Young's modulus higher than that of the organic material and is superior in toughness to that of silicon, a metal oxide, or the like. Therefore, the reinforcing film 37 is hardly damaged by constituting the reinforcing film 37 with metal, and as a result, damage such as cracks in the vibration region V can be effectively prevented. Particularly, in the embodiment, since the reinforcing film 37 is exposed to the ink, a chemically stable metal is preferable as the metal constituting the reinforcing film 37, and specifically, for example, it is preferable that gold (Au), platinum (Pt), nickel (Ni), or the like is used. Here, since nickel has a Young's modulus higher than those of gold and platinum, the rigidity of the reinforcing film 37 can be easily increased, which is preferable. Gold and platinum are preferable because they are chemically stable compared to nickel.

A metal oxide generally has a Young's modulus higher than that of a metal. Therefore, it is easy to increase the rigidity of the reinforcing film 37 by constituting the reinforcing film 37 with a metal oxide, and as a result, damage such as cracks in the vibration region V can be effectively prevented. In particular, in the embodiment, since the reinforcing film 37 is exposed to the ink, a chemically stable metal oxide is preferable as the metal oxide constituting the reinforcing film 37, and specifically, for example, alumina ($Al_2O_3$), silicon oxide ($SiO_X$), silicon nitride ($SiN_X$), tantalum oxide ($TaO_X$), yttria-stabilized zirconia (YSZ), zirconia ($ZrO_2$), or the like is exemplified.

In addition, the piezoelectric element 38 is disposed on the surface of the vibration plate 36 on a side opposite to the pressure chamber C. As illustrated in FIGS. 5, 6, and 7, the piezoelectric element 38 is substantially constituted of a lamination of a first electrode 381, a piezoelectric layer 383, and a second electrode 382. Each of the first electrode 381, the piezoelectric layer 383, and the second electrode 382 is formed by, for example, a known film formation technique such as sputtering and a known processing technique using photolithography, etching, or the like. Other layers such as layers for enhancing adhesion may be interposed between layers of the laminate and between the piezoelectric element 38 and the vibration plate 36 as appropriate.

The first electrode 381 is disposed on the surface of the vibration plate 36, specifically, is disposed on a surface of the second layer 362 on a side opposite to the first layer 361. The first electrodes 381 are individual electrodes disposed to be separated from each other for each piezoelectric element 38. Specifically, a plurality of first electrodes 381 extending in the X direction are arranged in the Y direction with intervals therebetween. A drive signal for ejecting the ink from the nozzle N corresponding to the piezoelectric element 38 is applied to the first electrode 381 of each piezoelectric element 38 via the wiring substrate 50.

The piezoelectric layer 383 is disposed on the surface of the first electrode 381. The piezoelectric layer 383 has a strip shape extending in the Y direction so as to be continuous over the plurality of piezoelectric elements 38. Although not illustrated, a through-hole penetrating the piezoelectric layer 383 is provided to extend in the X direction in a region corresponding to a gap of respective pressure chambers C adjacent to each other in a plan view in the piezoelectric layer 383. A constituting material of the piezoelectric layer 383 is, for example, a piezoelectric material such as lead zirconate titanate.

The second electrode 382 is disposed on the surface of the piezoelectric layer 383. Specifically, the second electrode 382 is a band-like common electrode extending in the Y direction so as to be continuous over the plurality of piezoelectric elements 38. A predetermined reference voltage is applied to the second electrode 382.

As described above, the piezoelectric element 38 includes the first electrode 381 disposed on the surface of the vibration plate 36, the second electrode 382 disposed with the first electrode 381 interposed between the vibration plate 36 and the second electrode 382, and the piezoelectric layer 383 disposed between the first electrode 381 and the second electrode 382. As described above, the piezoelectric element 38 is directly disposed on the vibration plate 36. Therefore, a driving force from the piezoelectric element 38 can be efficiently transmitted to the vibration plate 36 compared with a case where the piezoelectric element 38 is disposed on the vibration plate 36 via another member.

The liquid ejecting head 26 described above includes the vibration plate 36 constituting a part of the wall surface of the pressure chamber C accommodating the ink which is an example of the liquid, the piezoelectric element 38 vibrating the vibration plate 36, and the reinforcing film 37 disposed on the surface of the vibration plate 36 on a pressure chamber C side. Here, the vibration region V, which is a region of the vibration plate 36 and is vibrated by the piezoelectric element 38, has an elongated shape in a plan view as viewed in the thickness direction of the vibration plate 36. The vibration region V includes the first regions V1 in which the reinforcing film 37 is not disposed, and the second region V2 which is located at a position closer to the center of the vibration region V in the longitudinal direction than the first regions V1 and in which the reinforcing film 37 is disposed.

As described above, the reinforcing film 37 is disposed in the second region V2, but is not disposed in the first regions V1 of the vibration region V. Therefore, it is possible to reduce the damage of the center of the vibration region V in the X direction due to a reaction force from the ink in the pressure chamber C while ensuring a necessary amount of deformation for the entire vibration region V.

More specifically, since the reinforcing film 37 is disposed in the second region V2, the second region V2 is hardly deformed. Therefore, it is possible to reduce the deformation of the center of the vibration region V in the X direction due to the reaction force from the ink in the pressure chamber C compared with a case where the reinforcing film 37 is not disposed in the vibration region V. On the other hand, since the reinforcing film 37 is not disposed in the first regions V1 of the vibration region V, the first regions V1 are more easily deformed than the second region V2. Therefore, it is possible to ensure a necessary amount of deformation for the vibration of the entire vibration region V.

In addition, the second region V2 is located at the position closer to the center of the vibration region V in the longitudinal direction than the first regions V1. That is, the reinforcing film 37 is unevenly disposed toward the center of the vibration region V in the longitudinal direction. Therefore, it is easy to reduce the deformation of the center of the vibration region V in the X direction due to the reaction force from the ink in the pressure chamber C while ensuring a necessary amount of deformation for the entire vibration region V compared with a case where the reinforcing film 37 is unevenly disposed to an end of the vibration region V in the longitudinal direction.

In a case where the plurality of nozzles N described above are disposed at a high density of 300 dpi or more, a width W of the vibration region V becomes extremely small. In this case, in order to ensure the necessary amount of deformation of the vibration region V, it is necessary to reduce the thickness of the vibration region V, and damage such as cracks in the vibration region V easily occurs. In the embodiment, even in this case, it is possible to reduce the damage of the center of the vibration region V in the X direction due to the reaction force from the ink in the pressure chamber C while ensuring a necessary amount of deformation for the entire vibration region V.

In addition, in the liquid ejecting apparatus 100 having the liquid ejecting head 26 exhibiting such an effect, high-precision liquid ejection can be stably realized over a long period of time. In addition, it is possible to reduce a size of the liquid ejecting head 26 by disposing the plurality of nozzles N at a high density, accordingly, it is possible to reduce a size of the liquid ejecting apparatus 100 having the liquid ejecting head 26.

From the viewpoint of easily obtaining the above effect of the liquid ejecting head 26, when a length of the vibration region V in the X direction is L and a length of the second region V2 or the reinforcing film 37 in the X direction is L2, L2/L is preferably within a range of 0.1 or more and 0.5 or less, and is more preferably within a range of 0.1 or more and 0.3 or less.

Figure 8:
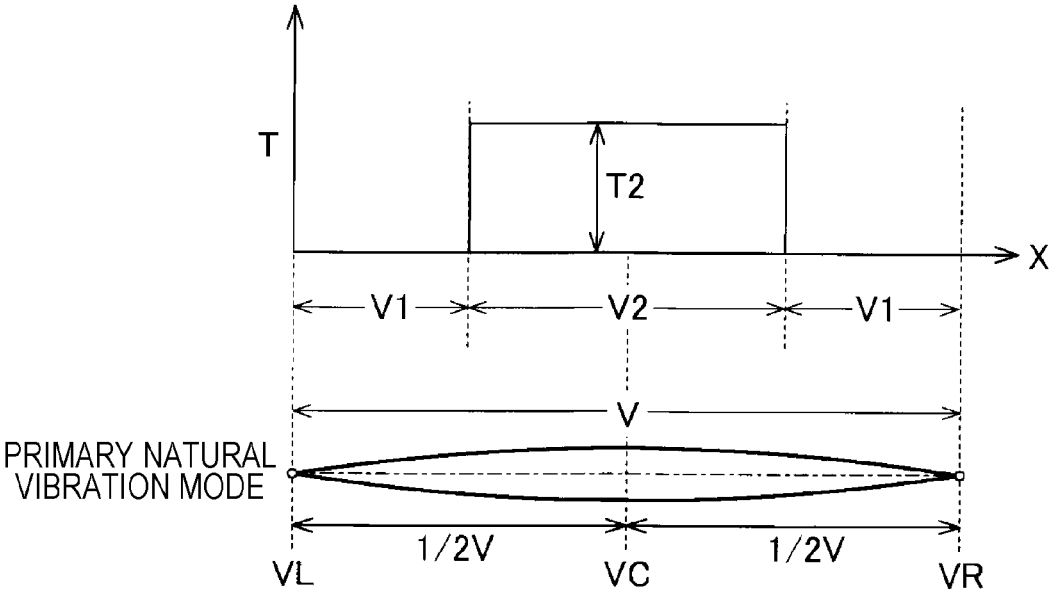
FIG. 8 is a view illustrating a relationship between a thickness of a reinforcing film and a primary natural vibration mode of a vibration region in the first embodiment.

FIG. 8 is a view illustrating a relationship between a thickness T of the reinforcing film 37 and a primary natural vibration mode of the vibration region V in the first embodiment. The vibration region V includes a plurality of natural vibration modes. Among the plurality of natural vibration modes, primary to tertiary natural vibration modes having both ends VR and VL as fixed ends in the longitudinal direction of the vibration region V have amplitudes larger than those of other natural vibration modes, thereby being likely to cause damage to the vibration region V. Particularly, the primary natural vibration mode has an amplitude larger than those of the other natural vibration modes. As illustrated in FIG. 8, the reinforcing film 37 includes a position of an antinode of the primary natural vibration mode, that is, a center VC of the vibration region V in the longitudinal direction. Therefore, it is possible to effectively reduce the damage of the vibration region V compared with a case where the reinforcing film 37 does not include the center VC of the vibration region V.

In the embodiment, as illustrated in FIG. 8, the thickness T of the reinforcing film 37 is constant at a thickness T2 in the second region V2. The thickness T of the reinforcing film 37 is not particularly limited, but is preferably within a range of 0.1 μm or more and 1000 μm or less. The thickness T is within the range, so that it is possible to obtain required rigidity of the reinforcing film 37 while facilitating the formation of the reinforcing film 37. The thickness T of the reinforcing film 37 in the Y direction may be continuously reduced from the second region V2 side toward the first region V1 side. In this case, it is possible to reduce stress concentration occurring between the first region V1 and the second region V2.

1-4. Manufacturing Method of Pressure Chamber

Figure 9:
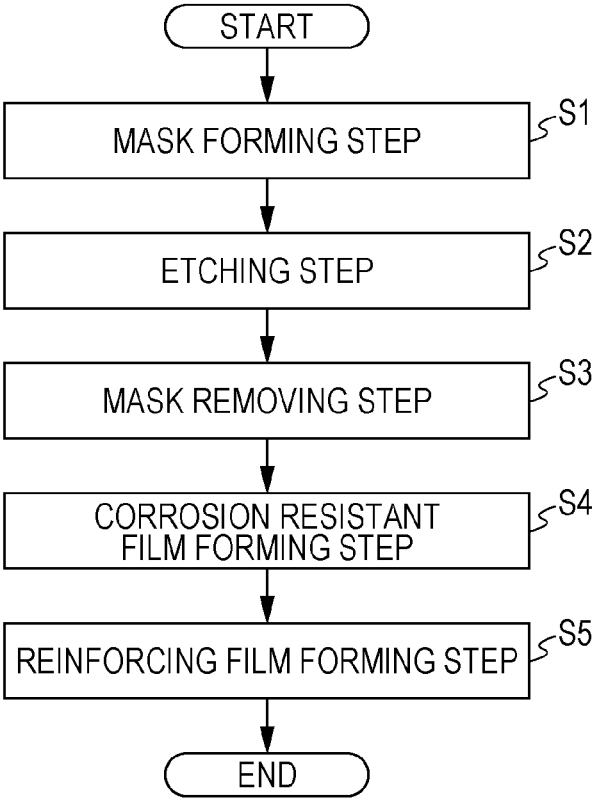
FIG. 9 is a flowchart illustrating a flow of manufacturing steps of a pressure chamber.

FIG. 9 is a flowchart illustrating a flow of manufacturing steps of the pressure chamber C. As illustrated in FIG. 9, the manufacturing steps of the pressure chamber C include a mask forming step S1, an etching step S2, a mask removing step S3, a corrosion resistant film forming step S4, and a reinforcing film forming step S5. Hereinafter, an outline of each step will be sequentially described.

Figure 10:
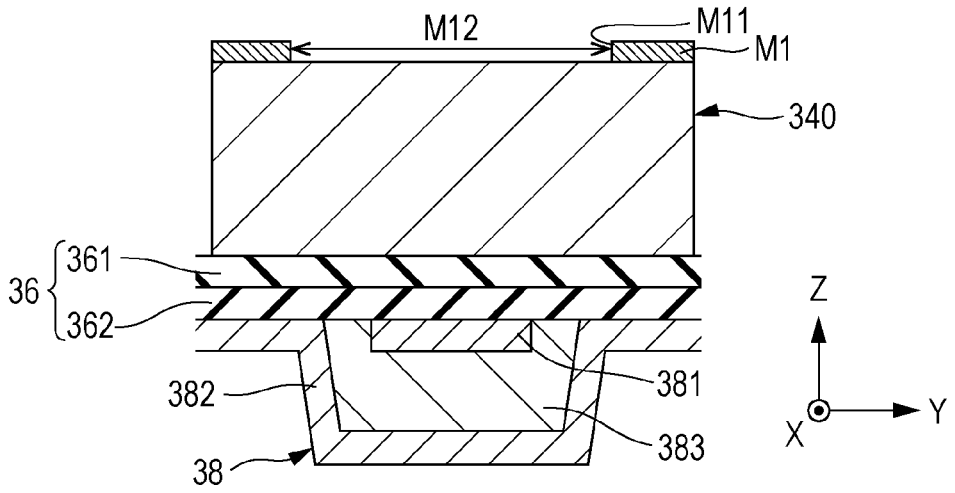
FIG. 10 is a sectional view illustrating a mask forming step.

FIG. 10 is a sectional view illustrating the mask forming step S1. As illustrated in FIG. 10, in the mask forming step S1, first, a substrate 340, which is a silicon single crystal substrate of which a plate surface is the (110) plane, is prepared. The substrate 340 is a substrate to be the pressure chamber substrate 34 described above. A mask M1 having an opening M11 is formed on an upper surface of the substrate 340 in FIG. 10. Here, the vibration plate 36 is formed on a lower surface of the substrate 340 in FIG. 10. In the example illustrated in FIG. 10, the piezoelectric element 38 is formed on the vibration plate 36.

More specifically, first, the first layer 361 and the second layer 362 are sequentially formed on the lower surface of the substrate 340 in FIG. 10. Therefore, the vibration plate 36 is formed. In the case where the first layer 361 is made of, for example, silicon oxide, the first layer 361 is formed by thermal oxidation of the lower surface of the substrate 340 in FIG. 10. In the case where the second layer 362 is made of, for example, zirconium oxide, the second layer 362 is formed by forming a layer of zirconium on the first layer 361 by a known film deposition technique such as sputtering and thermally oxidizing the layer.

After forming the vibration plate 36, the first electrode 381, the piezoelectric layer 383, and the second electrode 382 are formed in this order on the vibration plate 36. Therefore, the piezoelectric element 38 is formed. The first electrode 381, the piezoelectric layer 383, and the second electrode 382 are respectively formed by, for example, a known film formation technique such as sputtering and a known processing technique using photolithography, etching, or the like. After forming the piezoelectric element 38, the upper surface of the substrate 340 in FIG. 10 is ground by chemical mechanical polishing (CMP) or the like, and flattening of the surface or adjustment of the thickness of the substrate 340 is performed as necessary.

After forming the piezoelectric element 38, the mask M1 having the opening M11 is formed on the upper surface of the substrate 340 in FIG. 10. The mask M1 is formed by, for example, a known film formation technique such as sputtering and a known processing technique using photolithography, etching, or the like. Here, the mask M1 is made of a material having resistance to an etching solution, for example, silicon nitride (SiN) used in the etching step S2 described later.

Figure 11:
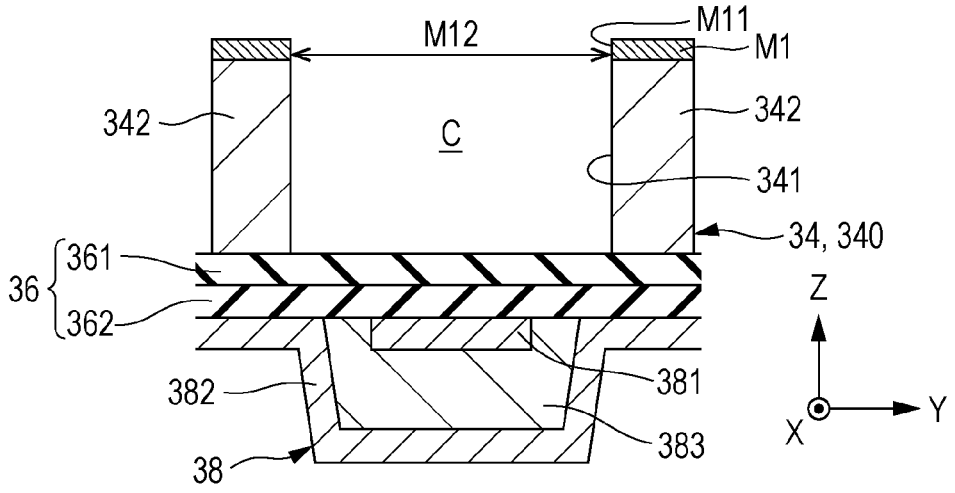
FIG. 11 is a sectional view illustrating an etching step.

FIG. 11 is a sectional view illustrating the etching step S2. As illustrated in FIG. 11, in the etching step S2, the substrate 340 is anisotropically etched via the opening M11 of the mask M1. The hole 341 is formed by the anisotropic etching. As the etching solution for the anisotropic etching, for example, a potassium hydroxide aqueous solution (KOH) or the like is used.

In the anisotropic etching, an etching rate for the (111) surface of the substrate 340 is extremely small as compared with an etching rate for the (110) surface of the substrate 340. Therefore, etching proceeds in a thickness direction of the substrate 340, and the hole 341 having the (111) plane as a wall surface is formed. Here, the vibration plate 36 functions as a stop layer for stopping the anisotropic etching. However, after stopping the anisotropic etching, the vibration plate 36 is exposed to the etching solution, and is slightly isotropically etched by the etching solution.

Figure 12:
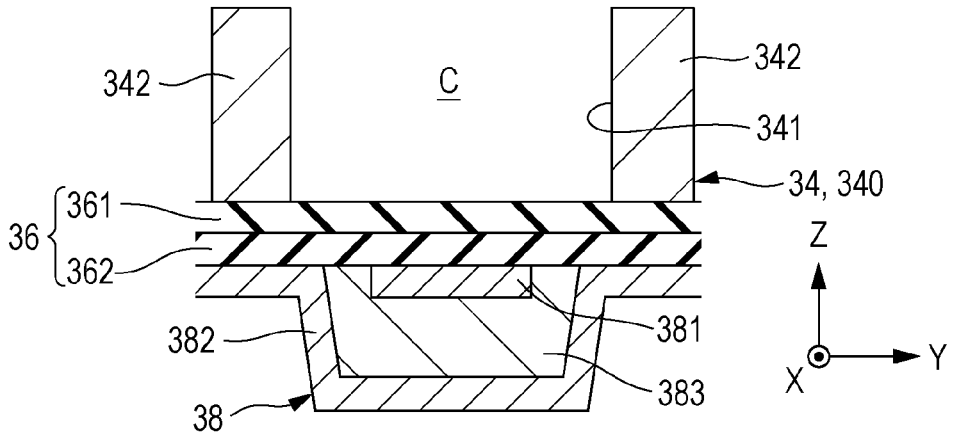
FIG. 12 is a sectional view illustrating a mask removing step.

FIG. 12 is a sectional view illustrating the mask removing step S3. As illustrated in FIG. 12, in the mask removing step S3, the mask M1 is removed. For removal of the mask M1, a liquid capable of dissolving the mask M1, for example, in a case where the mask M1 is composed of silicon nitride, hydrofluoric acid (HF) is used as a removal liquid.

Figure 13:
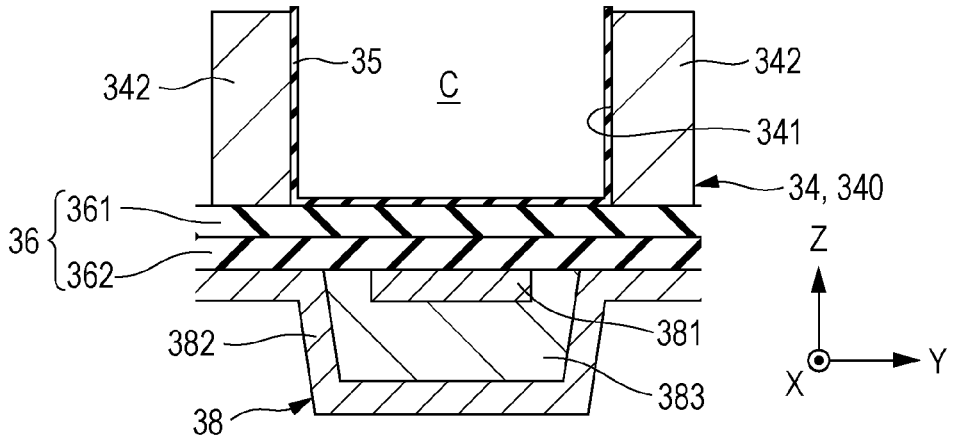
FIG. 13 is a sectional view illustrating a corrosion resistant film forming step.

FIG. 13 is a sectional view illustrating the corrosion resistant film forming step S4. As illustrated in FIG. 13, in the corrosion resistant film forming step S4, the corrosion resistant film 35 is formed. For example, the corrosion resistant film 35 is formed by a known film formation technique such as sputtering and a known processing technique using photolithography, etching, or the like. In FIG. 13, the corrosion resistant film 35 is not formed on the end surface of the partition wall portion 342 of the substrate 340 on a side opposite to the vibration plate 36, but the corrosion resistant film 35 may be formed on the end surface. In this case, the corrosion resistant film 35 can be formed only by forming a film by sputtering or the like.

Figure 14:
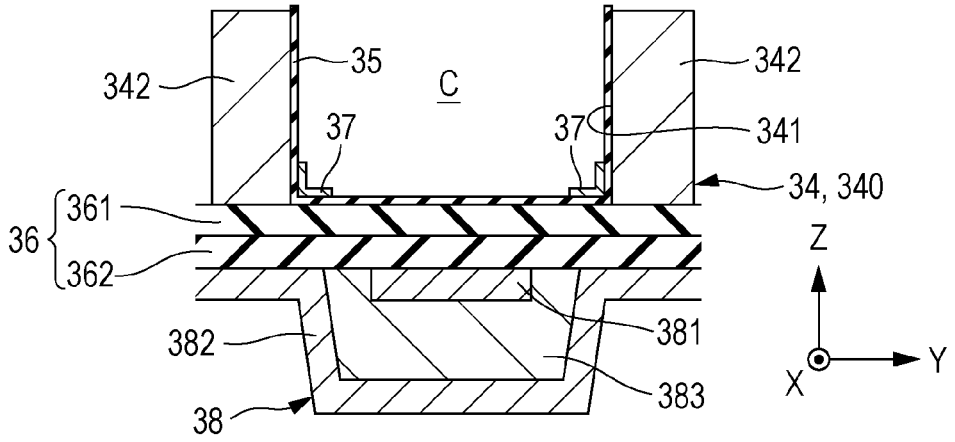
FIG. 14 is a sectional view illustrating a reinforcing film forming step.

FIG. 14 is a sectional view illustrating the reinforcing film forming step S5. As illustrated in FIG. 14, in the reinforcing film forming step S5, the reinforcing film 37 is formed. For example, the reinforcing film 37 is formed by a known film formation technique such as sputtering and a known processing technique using photolithography, etching, or the like. In addition, as described below, the reinforcing film 37 can also be formed by film formation by vapor deposition of physical vapor deposition or chemical vapor deposition using a mask.

Figure 15:
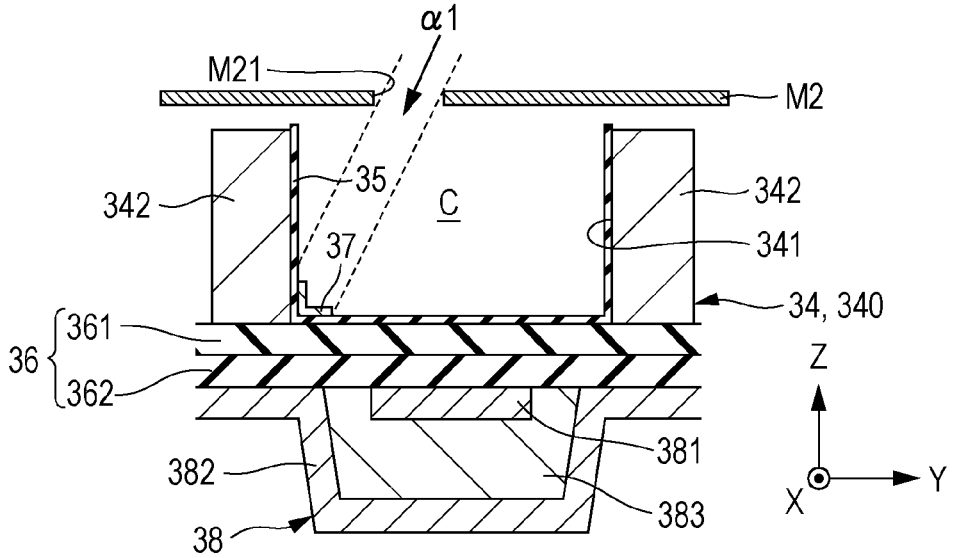
FIG. 15 is a sectional view illustrating a first step of the reinforcing film forming step.
Figure 16:
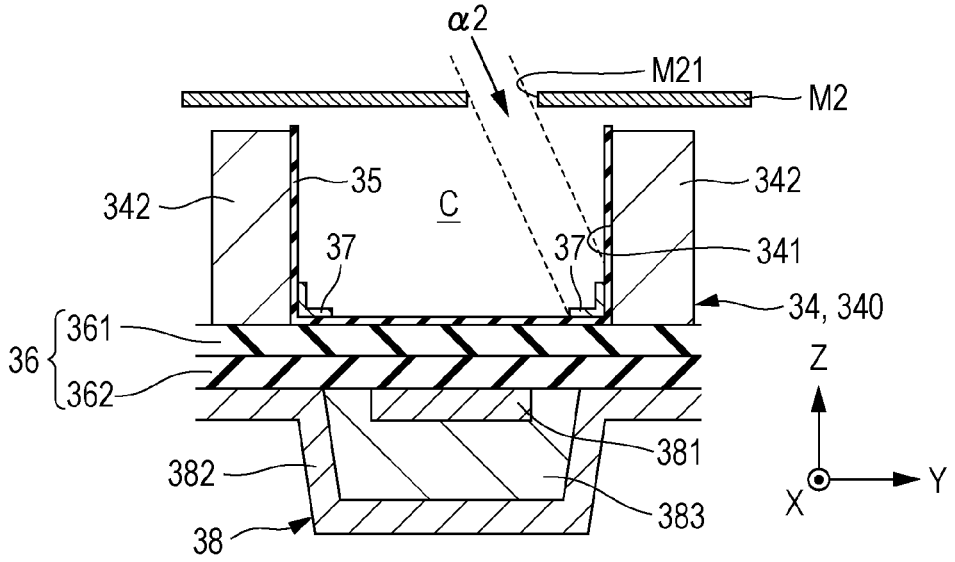
FIG. 16 is a sectional view illustrating a second step of the reinforcing film forming step.

FIG. 15 is a sectional view illustrating a first step of the reinforcing film forming step S5. FIG. 16 is a sectional view illustrating a second step of the reinforcing film forming step S5. In the first step illustrated in FIG. 15, a part of the reinforcing film 37 is formed by forming a film using a mask M2 and in the second step illustrated in FIG. 16, the remaining portion of the reinforcing film 37 is formed by using the mask M2.

Specifically, as illustrated in FIG. 15, in the first step, first, the mask M2 having an opening M21 is disposed on an upper side of the substrate 340 in FIG. 15. The mask M2 is a substrate having the opening M21. The opening M21 is disposed corresponding to a region in which the reinforcing film 37 is to be formed. In the first step, a vapor deposition material is deposited from a direction $\alpha 1$ inclined with respect to a normal direction of the substrate 340. Therefore, the disposition of the opening M21 is determined according to the direction $\alpha 1$. As a constituting material of the mask M2, for example, metal, glass, silicon, or the like can be exemplified. Among them, as the constituting material of the mask M2, it is preferable that the difference in coefficient of linear expansion from that of the constituting material of the substrate 340 is as small as possible, specifically silicon is preferable. It is possible to reduce the displacement of the opening M21 with respect to the substrate 340 by reducing the difference in the coefficient of linear expansion between the mask M2 and the substrate 340. After the first step, as illustrated in FIG. 16, in the second step, the disposition of the mask M2 is changed as necessary, and the vapor deposition material is deposited from a direction $\alpha 2$ inclined on a side opposite to the direction $\alpha 1$ with respect to the normal direction of the substrate 340.

The vapor deposition used in the first step and the second step may be either physical vapor deposition or chemical vapor deposition, but from the viewpoint of convenience, the physical vapor deposition is preferable, and more specifically, from the viewpoint that a dense film can be obtained compared to vacuum vapor deposition, ion beam assisted vapor deposition or ion plating, or the like is preferable.

2. Second Embodiment

A second embodiment of the present disclosure will be described. In the following examples, elements having functions similar to those in the first embodiment are denoted by the same reference numerals as those in the first embodiment and their detailed descriptions are appropriately omitted.

Figure 17:
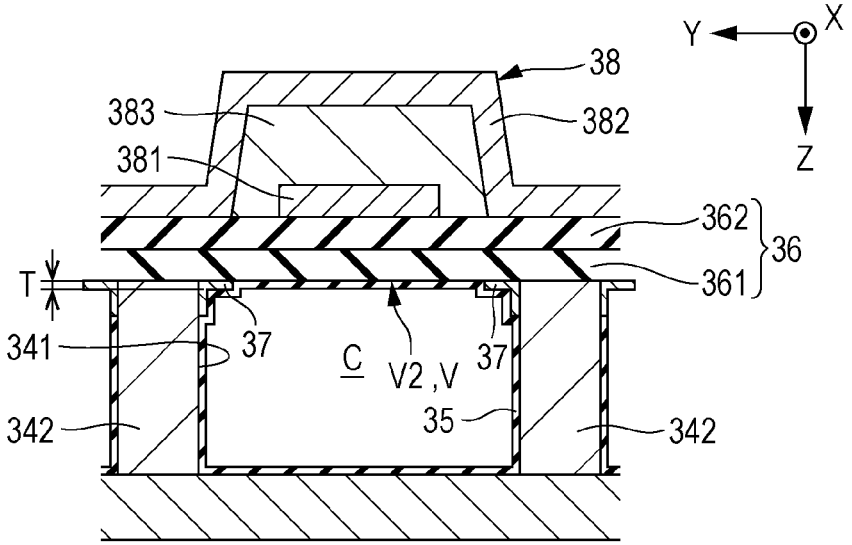
FIG. 17 is a transverse sectional view illustrating a pressure chamber in a second embodiment.

FIG. 17 is a transverse sectional view illustrating a pressure chamber C in the second embodiment. Also in the embodiment illustrated in FIG. 17, a corrosion resistant film 35 is disposed on a wall surface of the pressure chamber C. However, in the embodiment, a reinforcing film 37 is disposed between the wall surface of the pressure chamber C and the corrosion resistant film 35. Here, the resistance of the corrosion resistant film 35 to the ink in the pressure chamber C is higher than that of a vibration plate 36.

Therefore, a constituting material of the reinforcing film 37 is not limited as to whether it is resistant to ink in the pressure chamber C. As a result, a range of choice of the constituting material of the reinforcing film 37 is widened, a degree of freedom in design of the reinforcing film 37 can be increased, and the film formation of the reinforcing film 37 can be simplified. In addition, also in the embodiment, effects similar to those in the first embodiment can be obtained.

3. Third Embodiment

A third embodiment of the present disclosure will be described. In the following examples, elements having functions similar to those in the first embodiment are denoted by the same reference numerals as those in the first embodiment and their detailed descriptions are appropriately omitted.

Figure 18:
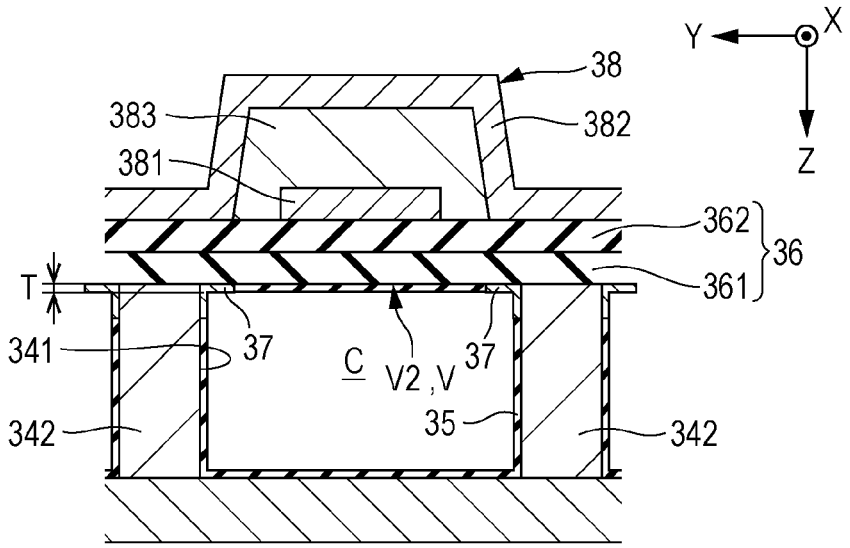
FIG. 18 is a transverse sectional view illustrating a pressure chamber in a third embodiment.

FIG. 18 is a transverse sectional view illustrating a pressure chamber C in the third embodiment. In the embodiment illustrated in FIG. 18, a corrosion resistant film 35 and a reinforcing film 37 are disposed on a wall surface of the pressure chamber C. The reinforcing film 37 is disposed on a corner on which a surface of a vibration plate 36 on a pressure chamber C side and a wall surface of a hole 341 are coupled to each other. The corrosion resistant film 35 is disposed over an entire wall surface of the pressure chamber C other than a region in which the reinforcing film 37 is disposed.

A constituting material of the reinforcing film 37 may be the same as or different from a constituting material of the corrosion resistant film 35. However, as in the first embodiment, since the reinforcing film 37 of the embodiment is exposed to the ink in the pressure chamber C, it is preferable to have a system for ink. In addition, in a case where the constituting material of the reinforcing film 37 is different from the constituting material of the corrosion resistant film 35, it is preferable that the constituting material of the reinforcing film 37 has a Young's modulus higher than that of the constituting material of the corrosion resistant film 35. In this case, the reinforcing film 37 is formed, for example, by modifying a part of the corrosion resistant film 35 with an ion beam or the like. The reinforcing film 37 may be formed by separate film formation from the corrosion resistant film 35.

Also in the embodiment using the reinforcing film 37 described above, effects similar to those in the first embodiment can be obtained.

4. Fourth Embodiment

A fourth embodiment of the present disclosure will be described. In the following examples, elements having functions similar to those in the first embodiment are denoted by the same reference numerals as those in the first embodiment and their detailed descriptions are appropriately omitted.

Figure 19:
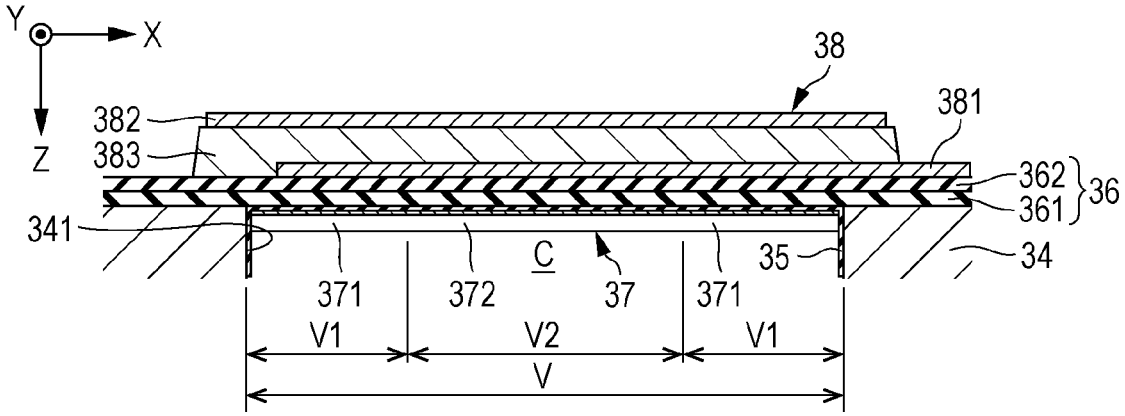
FIG. 19 is a longitudinal sectional view illustrating a pressure chamber in a fourth embodiment.

FIG. 19 is a longitudinal sectional view illustrating a pressure chamber C in the fourth embodiment. A liquid ejecting head 26 illustrated in FIG. 19 includes a vibration plate 36 constituting a part of a wall surface of the pressure chamber C accommodating ink that is an example of a liquid, a piezoelectric element 38 vibrating the vibration plate 36, and a reinforcing film 37 disposed on a surface of the vibration plate 36 on a pressure chamber C side. Here, a vibration region V, which is a region of the vibration plate 36 and is vibrated by the piezoelectric element 38, has an elongated shape in a plan view as viewed in a thickness direction of the vibration plate 36. The reinforcing film 37 includes first portions 371 having a first film thickness T1 and a second portion 372 disposed at a position closer to a center of the vibration region V than the first portions 371 in a longitudinal direction, and having a second film thickness T2 thicker than the first film thickness T1.

Since the reinforcing film 37 has two portions such as the first portion 371 and the second portion 372 having different film thicknesses, similar to the first embodiment described above, it is possible to reduce damage of a center of the vibration region V in the X direction due to the reaction force from the ink in the pressure chamber C while ensuring a necessary amount of deformation for the entire vibration region V.

A ratio T1/T2 of the first film thickness T1 and the second film thickness T2 is not particularly limited, but is preferably within a range of 0.1 or more and 0.5 or less. The ratio T1/T2 is set within the range, so that it is possible to obtain the necessary rigidity of the reinforcing film 37 while facilitating the formation of the reinforcing film 37.

Figure 20:
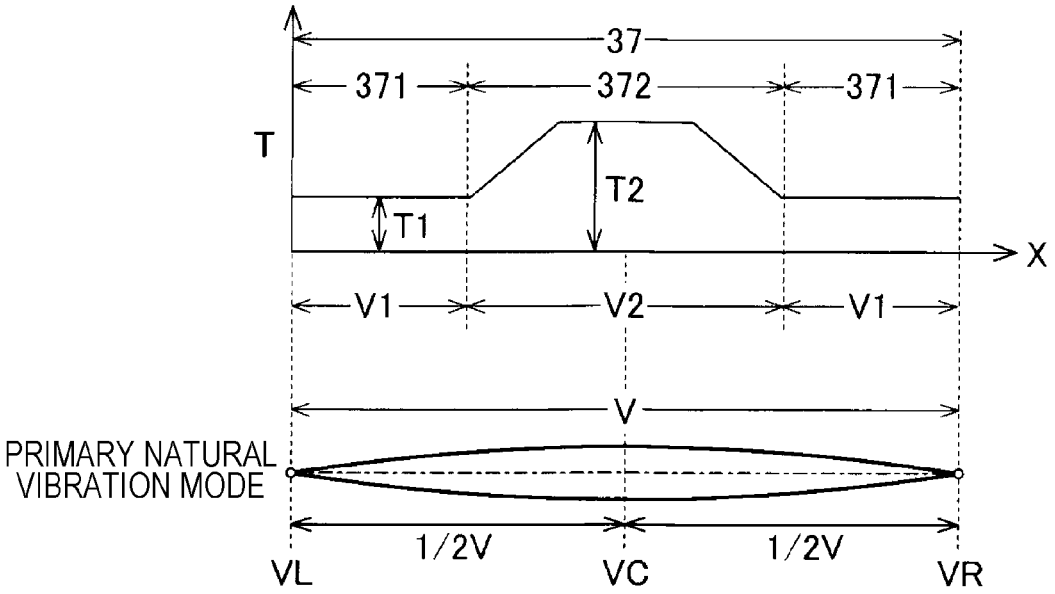
FIG. 20 is a view illustrating a relationship between a thickness of a reinforcing film and a primary natural vibration mode of a vibration region in the fourth embodiment.

FIG. 20 is a view illustrating a relationship between a thickness T of the reinforcing film 37 and a primary natural vibration mode of the vibration plate 36 in the fourth embodiment. In the embodiment, the second portion 372 is disposed at a center VC of the vibration region V in the longitudinal direction. As described above, the center VC of the vibration region V in the longitudinal direction is a position of an antinode of a primary natural vibration mode of the vibration region V. Therefore, it is possible to effectively reduce the damage of the vibration region V compared with a case where the second portion 372 is not disposed at the center VC of the vibration region V.

In the embodiment, as illustrated in FIG. 20, the thickness T of the reinforcing film 37 continuously decreases from a second region V2 side toward a first region V1 side. Therefore, it is possible to reduce stress concentration occurring between the first region V1 and the second region V2 compared with a case where the thickness T of the reinforcing film 37 abruptly changes between the first region V1 and the second region V2. The change in the thickness T of the reinforcing film 37 in the Y direction is not limited to the change illustrated in FIG. 20, but for example, may decrease in stages from the second region V2 side toward the first region V1 side.

5. Fifth Embodiment

A fifth embodiment of the present disclosure will be described. In the following examples, elements having functions similar to those in the first embodiment are denoted by the same reference numerals as those in the first embodiment and their detailed descriptions are appropriately omitted.

Figure 21:
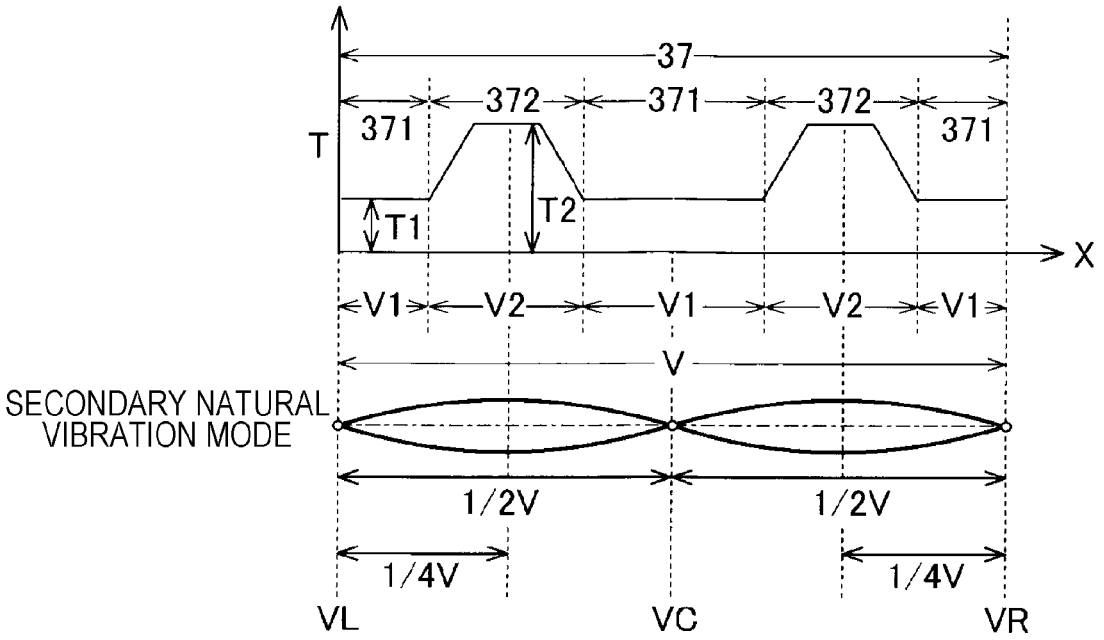
FIG. 21 is a view illustrating a relationship between a thickness of a reinforcing film and a secondary natural vibration mode of a vibration region in a fifth embodiment.

FIG. 21 is a view illustrating a relationship between a thickness T of a reinforcing film 37 and a secondary natural vibration mode of a vibration region V in the fifth embodiment. The reinforcing film 37 includes three first portions 371 and two second portions 372. The two second portions 372 are located at positions of antinodes of the secondary natural vibration mode of the vibration region V. Therefore, it is possible to effectively reduce the damage of the vibration region V due to the secondary natural vibration mode. Also in the embodiment using the reinforcing film 37 described above, effects similar to those in the first embodiment can be obtained. The first portion 371 may be omitted.

6. Sixth Embodiment

A sixth embodiment of the present disclosure will be described. In the following examples, elements having functions similar to those in the first embodiment are denoted by the same reference numerals as those in the first embodiment and their detailed descriptions are appropriately omitted.

Figure 22:
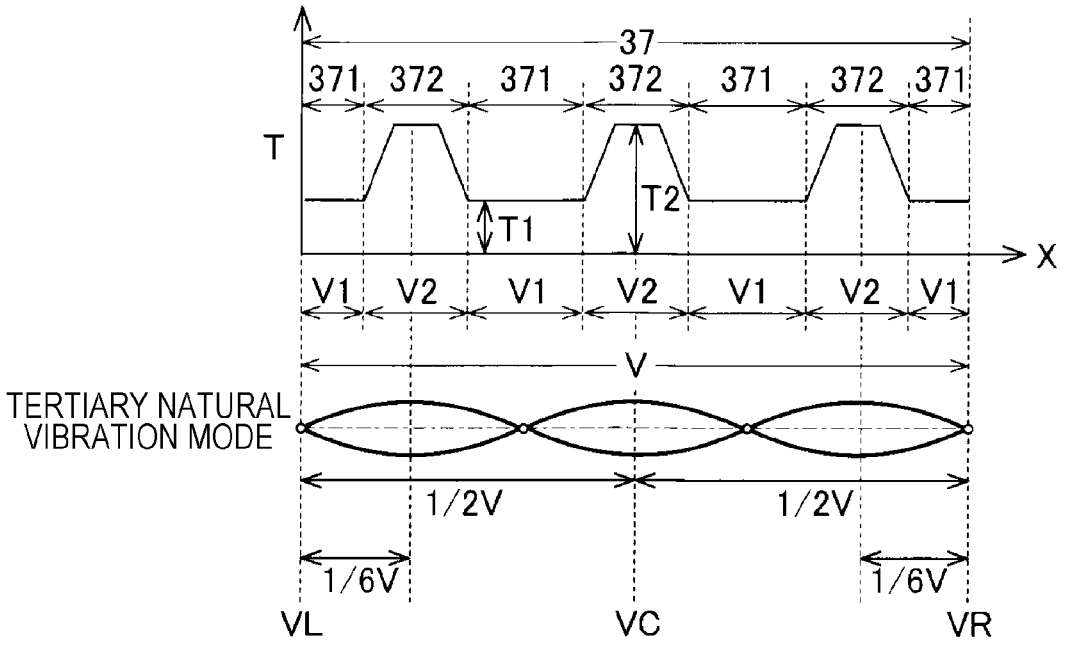
FIG. 22 is a view illustrating a relationship between a thickness of a reinforcing film and a tertiary natural vibration mode of a vibration region in a sixth embodiment.

FIG. 22 is a view illustrating a relationship between a thickness T of a reinforcing film 37 and a tertiary natural vibration mode of a vibration region V in the sixth embodiment. The reinforcing film 37 includes four first portions 371 and three second portions 372. The three second portions 372 are located at positions of antinodes of the tertiary natural vibration mode of the vibration region V. Therefore, it is possible to effectively reduce the damage of the vibration region V due to the tertiary natural vibration mode. Also in the embodiment using the reinforcing film 37 described above, effects similar to those in the first embodiment can be obtained. The first portion 371 may be omitted.

Modification Examples

Each of the embodiments in the above examples can be variously modified. Specific modification aspects that can be applied to each of the embodiments described above are illustrated below. Two or more aspects arbitrarily selected from the following examples can be appropriately combined within a range not inconsistent with each other.

(1) In each of the embodiments described above, a configuration, in which the first electrode 381 is an individual electrode and the second electrode 382 is a common electrode, is illustrated, but the first electrode 381 may be a common electrode continuous over the plurality of piezoelectric elements 38, and the second electrode 382 may be an individual electrode for each piezoelectric element 38. In addition, both the first electrode 381 and the second electrode 382 may be the individual electrodes.

(2) In each of the embodiments described above, the serial type liquid ejecting apparatus 100 reciprocating the carriage 242 on which the liquid ejecting head 26 is mounted is illustrated, but the present disclosure can be applied to a line type liquid ejecting apparatus in which the plurality of nozzles N are distributed over an entire width of the medium 12.

(3) The liquid ejecting apparatus 100 illustrated in each of the embodiments described above may be adopted in various apparatuses such as a facsimile apparatus and a copying machine, in addition to the apparatus dedicated to printing. However, the application of the liquid ejecting apparatus of the present disclosure is not limited to printing. For example, the liquid ejecting apparatus that ejects a solution of a coloring material is used as a manufacturing apparatus that forms a color filter of a liquid crystal display apparatus. In addition, the liquid ejecting apparatus that ejects a solution of a conductive material is used as a manufacturing apparatus forming wiring and electrodes of a wiring substrate.

What is claimed is:

1. A liquid ejecting head comprising:
a vibration plate constituting a part of a wall surface of a pressure chamber accommodating a liquid;
a piezoelectric element vibrating the vibration plate; and
a reinforcing film disposed on a surface of the vibration plate on a pressure chamber side, wherein
a vibration region, which is a region of the vibration plate and is vibrated by the piezoelectric element, has an elongated shape in a plan view viewed in a thickness direction of the vibration plate, and
the vibration region includes a first region in which the reinforcing film is not disposed and a second region which is located at a position closer to a center of the vibration region in a longitudinal direction than the first region, and in which the reinforcing film is disposed.

2. The liquid ejecting head according to claim 1, wherein the piezoelectric element includes
a first electrode,
a second electrode disposed such that the first electrode is interposed between the second electrode and the vibration plate, and
a piezoelectric layer disposed between the first electrode and the second electrode.

3. The liquid ejecting head according to claim 1, further comprising:
a substrate in which the vibration plate is disposed and a hole constituting the pressure chamber is provided, wherein
the reinforcing film is disposed on a corner on which the surface of the vibration plate on the pressure chamber side and a wall surface of the hole are coupled to each other.

4. The liquid ejecting head according to claim 1, further comprising:
a corrosion resistant film disposed on the wall surface of the pressure chamber and having resistance to the liquid higher than that of the vibration plate, wherein
the reinforcing film is disposed between the wall surface of the pressure chamber and the corrosion resistant film.

5. The liquid ejecting head according to claim 1, wherein
a constituting material of the reinforcing film is a metal.

6. The liquid ejecting head according to claim 1, wherein
a constituting material of the reinforcing film is a metal oxide.

7. A liquid ejecting apparatus comprising:
the liquid ejecting head according to claim 1.

* * * * *